United States Patent [19]

Fedolfi

[11] 4,011,697

[45] Mar. 15, 1977

[54] BUILDING CONSTRUCTION

[75] Inventor: James L. Fedolfi, Concord, N.H.

[73] Assignee: Luke J. Roddy, West Roxbury, Mass.

[22] Filed: Dec. 8, 1975

[21] Appl. No.: 638,549

[52] U.S. Cl. ..... 52/90; 52/86; 52/745

[51] Int. Cl.[2] ..... E04B 1/32

[58] Field of Search ..... 52/90, 86, 729, 731, 52/745

[56] References Cited

UNITED STATES PATENTS

| | | | |
|---|---|---|---|
| 2,482,918 | 9/1949 | Klump | 52/745 |
| 2,647,475 | 8/1953 | Dietrich | 52/86 |
| 2,675,769 | 4/1954 | Dosker | 52/86 |

*Primary Examiner*—J. Karl Bell

*Attorney, Agent, or Firm*—Jerry Cohen; Charles Hieken

[57] ABSTRACT

A storage/utility building comprises one or more modular arches with sidewall, mid roof and top roof panels on a skeletal structure defining a truss-free gambrel construction as a whole which can support at least 100 lbs. per sq. ft. live load, and substantially more, and more particularly comprises in the skeletal frame two end gambrel arches made up of framing members of bent sheet metal or extruded form with spanning purlins between the two end frames, the purlins also being of bent sheet metal or extruded form.

5 Claims, 14 Drawing Figures

BUILDING CONSTRUCTION

BACKGROUND OF INVENTION

The present invention relates to storage/utility buildings and is characterized by provision of the safety and load bearing characteristics of building construction in a light weight, economical unit, affording additional benefits of maximum open space within the enclosure defined by the building and avoidance of condensation.

Storage/utility buildings and sheds are used to store garden tools, supplies, livestock, pets, commercial inventory, tools and the like and comprise metal panels and skeletal framing members which can be erected by experienced construction crews or sold to inexperienced homeowners and commercial customers, including farmers, in kit form for assembly by them. Such purposes are also served by buildings jerry-built of a variety of other materials including wood, tar paper, scraps of shingling, etc. The prefabricated metal units have no significant load carrying ability and are not "buildings" in a conventional sense and those buildings of other materials mentioned above often yield to the buffeting of weather in 1–3 years.

However, metal building construction for major structures has been widespread, particularly in connection with warehouses and factories over the last 20 years. Such buildings have been widely sold in the United States under various brands of the Reynolds, Kirby and Butler companies and other sources. They generally comprise shed or peak roof construction of panels tied to self-supporting walls and roof purlins which run the length of the building. Their weather resistance, durability and load carrying ability meet the perceived demands of the market. However, they are expensive.

There is a substantial gap between the low cost, low performance portable metal sheds and the expensive "constructed" metal buildings.

It is an important object of the present invention to provide an effective building structure filling that gap of demand.

It is a further object of the invention to provide a basic construction usable in all size ranges from small tool or boat sheds to barn, factory or warehouse size constructions consistent with the preceding object.

It is a further object of the invention to provide a repeatable modular unit which can be assembled with like modules to provide a desired size of building consistent with one or both of the preceding objects.

It is a further object of the invention to carry significant live loads consistent with one or more of the preceding objects.

It is a further object of the invention to provide a light weight, economical structure making use of readily available, readily handled materials consistent with one or more of the preceding objects.

It is a further object of the invention to avoid the need for powered venting consistent with one or more of the preceding objects.

It is a further object of the invention to inherently eliminate condensation consistent with one or more of the preceding objects.

It is a further object of the invention to maximize available internal space within a building structure consistent with one or more of the preceding objects.

It is a further object of the invention to accommodate effective insulation and/or solar heating means consistent with one or more of the preceding objects.

SUMMARY OF THE INVENTION

In accordance with the invention, the foregoing objects are met by a building system focused around a building structure module in the form of a truss-free gambrel arch which can support at least 100 lbs. per sq. ft. live load (i.e., loading in addition to the building's own weight). Such arches are formed of skeletal gambrel arches comprising two end frames in gambrel form linked by horizontal purlins. The purlins are overlaid with paneling, preferably bent sheet metal or extruded sheet metal, but possibly comprising fiberglass reinforced plastics or the like, having at least 50,000 psi yield strength, and preferably as high as 80–100,000 psi yield strength, consistent with minimizing weight and cost of components. The panels are preferably corrugated or otherwise formed so that adjacent panels (considered in a horizontal plane cross-section) will define air spaces at their junctions.

Each end frame comprises, in accordance with gambrel definition, spaced vertical girts, supporting mid-roof girts at their tops, which in turn at their tops support top-roof girts. The stresses induced by weight and live loading are spread entirely through the exterior skeletal frame and the purlins and panels attached thereto. While gambrel construction can be modified within the scope of the invention to provide a larger number of mid-roof panels and, similarly, the two top-roof panels may comprise a single panel.

Other objects, features and advantages of the invention will be apparent from the following detailed description of preferred embodiments taken in connection with the accompanying drawing, in which:

DETAILED DESCRIPTION OF PREFERRED EMBODIMENTS

Figure 1:
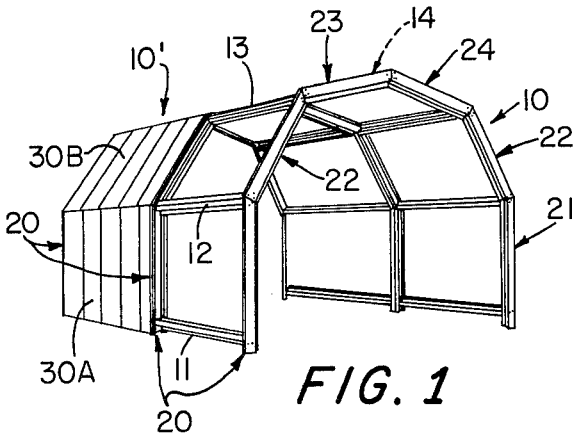
FIG. 1 is an isometric partially broken away view of two modular arches, each made in accordance with a preferred embodiment of the invention, assembled to define a building structure.

Referring now to FIG. 1 there are shown two identical modular arches 10 and 10', as generally described above and more particularly with each comprising two gambrel-type end frames 20. Such end frames are linked by two each of purlins 11, 12 and 13 and a single ridge purlin 14. The end frames 20 themselves comprise two upright girt framing members 21, two mid-roof girt framing members 22 and two top-roof girt framing members 23 and 24 metal panels, all of which are essentially identical, and indicated on one side of arch 10' as 30A, 30B and 30C (a similar three panels running down the other side of the arch) are tied to the purlins and girts to complete the arch.

Figure 2:
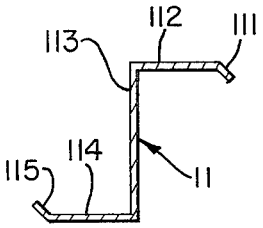
FIGS. 2–5 are cross-sections of four purlins used at different points of the structure, as indicated in FIG. 1.

Purlins 11, 12, 13 and 14 are shown in more detail in FIGS. 2–5, in cross-section. As shown in FIG. 2, purlin 11 comprises a metal sheet bent to form legs 111, 112, 113, 114 and 115.

Figure 3:
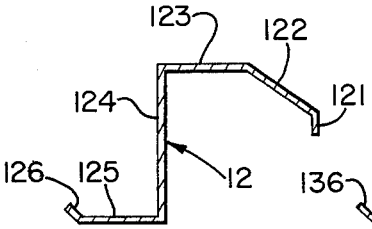
Figure 4:
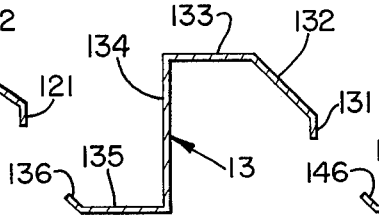
Figure 5:
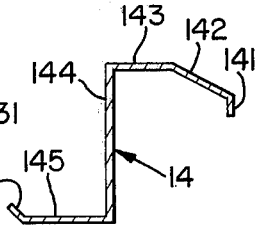

Purlin 12 as shown in FIG. 3 comprises legs 121–126, of which 123 and 125 will fit against the walls of frame members at the end of the purlin, it being understood however, that wall 125 will not be flush against a girt wall because of the bent shape of the girt wall (forming an acute angle, i.e., less than 90°) as shown below in connection with FIG. 6. Framing members 13 comprise legs 131–136 (FIG. 4) and members 14 comprise legs 141–146. It will be noted that purlins 12, 13 and 14 have one leg more than conventional purlins.

Figure 6:
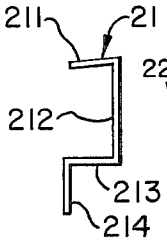
FIG. 6 is a common cross-section of various types of framing members used for the end frames of the FIG. 1 construction and FIGS. 6A–6D are plan views of metal sheet, before bending into the cross section of FIG. 6, showing the location of holes and notches necessary to proper assembly and stress distribution of loads through the framing members.
Figure 6A:
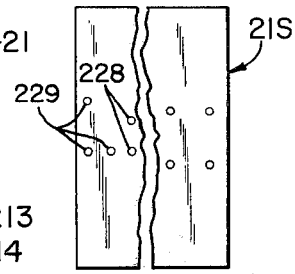

FIG. 6 shows the common cross-section for each of framing members 21, 22, 23 and 24, comprising for instance in the case of 21 legs 211, 212, 213 and 214. Legs 211 and 212 do not form a 90° angle as in conventional corner frame members, but rather form an angle of less than 90°, preferably 70°–88° and, more preferably, 85°.

Figure 7:
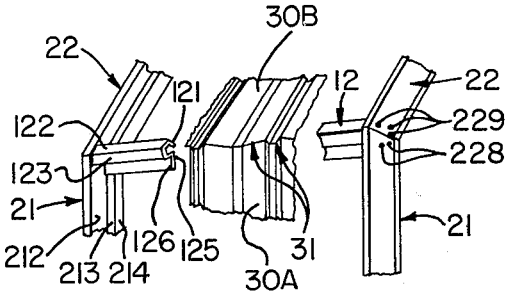
FIG. 7 is an isometric view of a blown up portion of FIG. 1, indicating junction details at frame-frame, frame-purlin and panel-panel intersections.
Figure 6B:
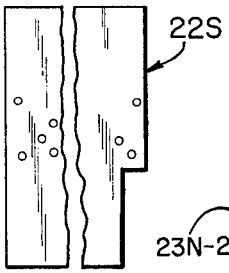
Figure 6C:
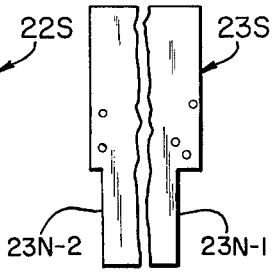
Figure 6D:
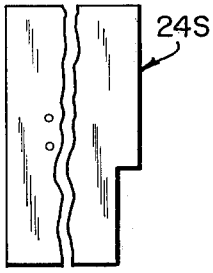

The sheets used to form girts 21, 22, 23, and 24 are indicated at 21S, 22S, 23S, 24S, respectively, in FIGS. 6A–6D, showing alignment holes therein 228 and 229 and various notches. The alignment holes 229 are used for tying overlapping portions of girts to each other and the alignment holes 228 are used for nut and bolt tying of the girts to end tabs (not shown) on the purlins, which may be spot welded or bolted to the purlins or formed as an integral extension thereof. The notching of girts are shown in FIGS. 6B, 6C and 6D allows the frame members to rest on each other at significant contact points for transmitting and spreading stress throughout the end frames and for aligning holes 229 for tying by bolts or other tying means. These tie-ins and overlaps are shown in more detail in FIG. 7 which also shows the overlap of panels 30A and 30B, the cross-section of which is such that at the junction of panels 30A and 30B there are covered air spaces 31 which allow escape of moisture laden air from the building structure, relying solely on convective movement of air without necessary reliance on powered venting to avoid condensation.

Figure 8:
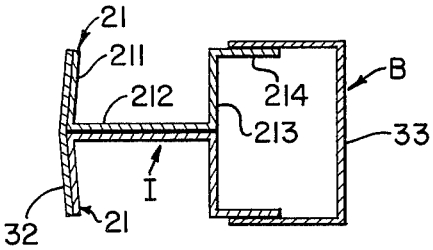
FIG. 8 is a cross-section of corner frame members of adjacent modular arches, with additional trim and structural elements to provide a combined eye beam/-box beam construction at such contacting corners utilizing the existing frame members of each arch at such corners.

FIG. 8 shows a corner detail wherein two corner girts 21 belonging to different modules 10 and 10' are overlaid with a trim strip 32. It is possible to go beyond mere trimming by making substantial connection between legs 211 of the girts 21 and metal strip 32 over the full length of the framing portion, e.g. by welding along such full length or by placing tie bolts along every 6–18 inches of length, and similarly tying a U-form metal piece 33 to the legs 214 of the girts 21 to form a box beam/I beam combination as indicated at B and I from the existing frame members 21 and utilizing a piece 32 that would be required for exterior trim in any event, to enhance the strength of the combined structure.

Figure 9:
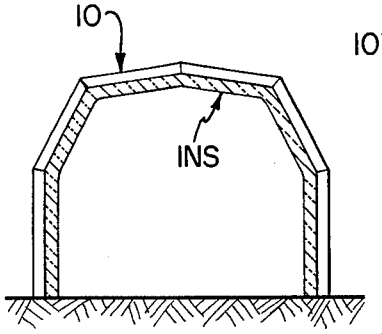
FIG. 9 is a schematic cross sectional view of a modular arch containing a pop-type insulation panel.

FIG. 9 shows a building 10 containing an insulation batt, indicated as INS, which is self-supporting and pops out to fit within the gambrel cross-section form of module 10.

Figure 10:
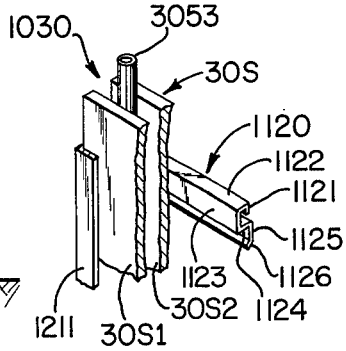
FIG. 10 is a blown-up isometric view of a construction detail in accordance with a further embodiment of the invention utilizing solar panel and accommodating such solar paneling, along with purlins within frame channeling, rather than outside the frame channeling.

FIG. 10 indicates usage of solar panels 30S in lieu of panels 30A, 30B, 30C, etc. described above in connection with the previous embodiments. Solar panel 30S comprises an outer translucent panel 30S1, a spaced inner absorbing radiating surfaced panel 30S2 (e.g., anodized aluminum) and heat transfer circulating means such as copper pipes carrying water, indicated therebetween at 30S3. The panels 30S may be hung on the outside of the purlins and girts as mere replacements for panels 30A, 30B, 30C, etc. or may be tucked within the girt leg 1211 as indicated at FIG. 10, using purlins with a shorter width so that both the solar panels and purlins are accommodated within the channeling of the girts.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

What is claimed is:

1. A building structure module for defining a roofed-over, walled enclosure and supporting at least one hundred pounds per square foot live load, comprising, means defining a supporting skeleton of girts arrayed as gambrel arch frames at two ends of the module, and wherein the girts of the end frames of each gambrel arch are secured end to end and comprise overlapping girt end faces with a higher one resting on a lower one at each angle bend of the gambrel arch to distribute roof loading, and further comprising, means defining horizontal purlins interconnecting the frames, the girts and purlins being arranged in a truss-free gambrel arch and overlaid with essentially end-to-end arrayed panels of at least 50,000 psi yield strength, along the side wall, mid roof and top roof sections of the gambrel arch.

2. Building structure module in accordance with claim 1 wherein the panels are shaped to provide air spaces at overlapping ends to avoid condensation within the arch.

3. Building structure in accordance with claim 1 comprising at least two such modules, longitudinally aligned and connected end to end at respective adjacent end frames thereof.

4. Building structure in accordance with claim 3 and further comprising means for converting the adjacent end frame members of adjacent modules into box/I beams each of which comprises the base of the I beam forming a U-form end of the box beam which extends away from the I beam.

5. Building structure in accordance with claim 1 wherein the purlins engage the girts at said angle bends and have two walls conforming to bent edges of said girts.

* * * * *